US008888099B2

(12) United States Patent
Knell et al.

(10) Patent No.: US 8,888,099 B2
(45) Date of Patent: Nov. 18, 2014

(54) SELF-STABILIZING JIGSAW PUZZLE

(75) Inventors: Florian Knell, Eberhardzell-Muehlhausen (DE); Jörg R. Bauer, Weingarten (DE)

(73) Assignee: Ravensburger Spieleverlag GmbH, Ravensburg (DE)

( * ) Notice: Subject to any disclaimer, the term of this patent is extended or adjusted under 35 U.S.C. 154(b) by 247 days.

(21) Appl. No.: 13/512,658

(22) PCT Filed: Nov. 30, 2010

(86) PCT No.: PCT/EP2010/007259

§ 371 (c)(1), (2), (4) Date: Jul. 19, 2012

(87) PCT Pub. No.: WO2011/063986

PCT Pub. Date: Jun. 3, 2011

(65) Prior Publication Data

US 2012/0280450 A1 Nov. 8, 2012

(30) Foreign Application Priority Data

Nov. 30, 2009 (DE) ..... 10 2009 056 286

(51) Int. Cl.
*A63F 9/12* (2006.01)

(52) U.S. Cl.
CPC ..... *A63F 9/12* (2013.01)
USPC ..... 273/157 R

(58) Field of Classification Search
CPC ..... A63F 9/12; A63F 9/10; A63F 9/1208; A63F 2009/124
USPC ..... 273/157 R, 156
See application file for complete search history.

(56) References Cited

U.S. PATENT DOCUMENTS 1,409,082 A * 3/1922 Corbett ..... 273/157 R
2,711,595 A * 6/1955 Sharp ..... 434/159

(Continued)

FOREIGN PATENT DOCUMENTS

CN 2703562 Y * 6/2005
DE 20004997 U1 * 6/2000

(Continued)

OTHER PUBLICATIONS

International Search Report for Appln. No. PCT/EP2010/007259 mailed Mar. 16, 2011.

(Continued)

*Primary Examiner* — Steven Wong
(74) *Attorney, Agent, or Firm* — Carter, DeLuca, Farrell & Schmidt, LLP

(57) ABSTRACT

The disclosure relates to a jigsaw puzzle having at least two puzzle parts wherein each of the mutually facing circumferential edge sections on both sides of the connecting region and remote from the latter is provided with at least one circumferential edge piece, along which the course of the circumferential edge is defined by the bisector of a two-dimensional angle which is formed between two straight lines which intersect on the bisector and by an upper end point of the associated one of the mutually facing circumferential edge sections of the two puzzle parts to an upper end point of an opposite circumferential edge of the same puzzle part such that when puzzle parts are joined together along mutually facing circumferential edge sections, contact between the two puzzle parts occurs exclusively on said circumferential edge pieces and in the region of the undercut.

16 Claims, 4 Drawing Sheets

(56) References Cited

U.S. PATENT DOCUMENTS

Figure 1A:
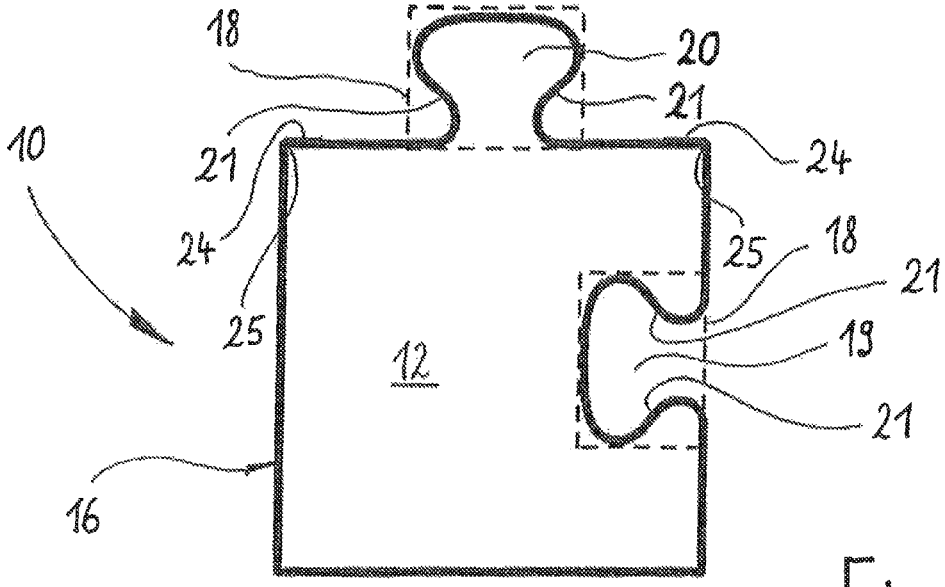

| | | | | |
|---|---|---|---|---|
| 2,987,318 | A * | 6/1961 | Hammer | 273/157 R |
| 3,174,893 | A * | 3/1965 | Church et al. | 108/161 |
| 3,578,331 | A * | 5/1971 | DeGast | 273/157 R |
| 3,691,704 | A * | 9/1972 | Novak | 52/81.4 |
| 3,865,382 | A * | 2/1975 | Myller | 273/157 R |
| 3,909,003 | A * | 9/1975 | Rabinovich | 273/157 R |
| 4,824,112 | A * | 4/1989 | Roy | 273/157 R |
| 5,104,125 | A * | 4/1992 | Wilson | 273/157 R |
| 5,217,226 | A * | 6/1993 | Christopher | 273/157 R |
| 5,842,697 | A | 12/1998 | Scott et al. | |
| 6,073,929 | A * | 6/2000 | Nahon | 273/156 |
| 7,490,831 | B2 * | 2/2009 | Simmons | 273/156 |
| 8,544,849 | B2 * | 10/2013 | Knell et al. | 273/157 R |

FOREIGN PATENT DOCUMENTS

| | | | |
|---|---|---|---|
| DE | 60300658 | | 10/2005 |
| DE | 20 2006 011 111 | U1 | 1/2007 |
| EP | 887093 | A1 * | 12/1998 |
| EP | 1 524 014 | A1 | 4/2005 |

OTHER PUBLICATIONS

Chinese Search Report issued in corresponding Chinese Patent Application No. 201080054288.0 on Dec. 4, 2013.

* cited by examiner

SELF-STABILIZING JIGSAW PUZZLE

The present disclosure relates to a jigsaw puzzle having the features disclosed herein. Jigsaw puzzles of the type mentioned are known to almost everyone; they exist in the form of a flat, two-dimensional design and recently also in a three-dimensional form, for example in a spherical shape.

In the case of jigsaw puzzles made of cardboard material, which constitute the majority of all jigsaw puzzles, the individual puzzle pieces are produced by a stamping operation and therefore have a greater or lesser play in the joined-together state along the connecting edge of the individual puzzle pieces. Many conventional two-dimensional jigsaw puzzles, for example, cannot therefore be lifted in the assembled state, since individual puzzle pieces become detached from one another again during the lifting attempt.

Also known are three-dimensional, self-supporting jigsaw puzzles which when all of the puzzle pieces are in the assembled state result in a hollow body, for example a sphere. In the case of such jigsaw puzzles, the individual puzzle pieces are generally made of plastic by injection moulding. The term "self-supporting" here means that the hollow body resulting after assembly of the puzzle pieces has no separate supporting structure on which the puzzle pieces are to be fastened or on which they are supported. In order for such a jigsaw puzzle to be self-supporting, at the connecting edges of the individual puzzle pieces there is no play as in the above-mentioned two-dimensional jigsaw puzzle, but rather the individual puzzle pieces are produced such that on joining them together a greater or lesser clamping action results. In practice, however, the effort required to assemble the individual puzzle pieces varies. In particular towards the end of the jigsaw puzzle, when almost all the puzzle pieces have already been connected to one another, the fitting-in of the final puzzle pieces requires too great a force.

The object on which the invention is based is to specify a jigsaw puzzle, in which the individual puzzle pieces stabilise themselves in the joined-together state, irrespective of whether it is a two-dimensional or a three-dimensional jigsaw puzzle.

This object is achieved according to the invention with a jigsaw puzzle having the features specified in the present disclosure. In contrast to the prior art, according to the invention the individual puzzle pieces are supported against one another not more or less randomly, but in a precisely defined manner. The invention makes use of the fact that for connecting the individual puzzle pieces to one another practically all jigsaw puzzles are provided with extensions or noses and corresponding recesses or indentations, which each have undercut regions. Through suitable shaping, these undercut regions are used to draw two joined-together puzzle pieces towards one another. The special configuration, according to the invention, of mutually facing circumferential edge portions furthermore ensures that the above-mentioned force produced by the contact of the puzzle pieces in the region of the undercut leads to a contact of mutually opposite circumferential edge portions only at places which are far away, preferably as far away as possible, from the connecting region with its undercut or undercuts. Thus, a sufficiently large base for the effective support of each two puzzle pieces against one another is created, while the special edge shaping in the mutually contacting circumferential edge pieces at the same time ensures that two joined-together puzzle pieces cannot tilt relative to one another. Overall, this produces between each two joined-together puzzle pieces a triangle of forces which has the region of the undercut and the mutually contacting circumferential edge portions as corner points and fastens the two puzzle pieces to one another stably and yet such that they can be easily separated. Jigsaw puzzles according to the invention are therefore self-stabilising and self-supporting. The contact between an extension and the associated recess in the region of the or each undercut is furthermore formed such that each extension can be inserted into the associated recess both from above and from below.

The solution according to the invention can be employed in two-dimensional jigsaw puzzles, in which the individual puzzle pieces are plane, but equally well also in all kinds of three-dimensional jigsaw puzzles, in which the individual puzzle pieces may be plane or variously curved. Completely new jigsaw puzzles previously not realisable in self-supporting form, such as, for example, bridge structures, can be realised according to the invention, since force lines are formed between the contact places of the mutually facing circumferential edge pieces of all the puzzle pieces of a jigsaw puzzle, which force lines extend over the jigsaw puzzle in the assembled state and stably hold it together. According to the invention, twisting or bending of relative large areas formed from a large number of individual puzzle pieces no longer occurs or occurs to an extent that is no longer disturbing, and individual puzzle pieces no longer fall out of the puzzle piece assembly by themselves.

In order to make the supporting base length of the triangle of forces described as large as possible, in preferred embodiments of the jigsaw puzzle according to the invention the circumferential edge pieces at which joined-together puzzle pieces touch are arranged in a manner immediately adjoining corners of the puzzle pieces or neighbouring these corners.

While it is sufficient if, when seen in cross-section, only part of the edge course between the upper face and the lower face of the puzzle piece is determined by the bisector defined in the present disclosure along, i.e. in the circumferential direction of the circumferential edge pieces, in preferred configurations substantially the entire edge course between the upper face and the lower face of the puzzle piece follows this bisector, in order to maximise the contact area over which two opposite circumferential edge pieces are supported against one another. However, if it is necessary for manufacturing reasons or desired on aesthetic grounds, the edge course may run differently close to the upper face and/or the lower face, for example may be of rounded design.

While the edge course of the mutually contacting circumferential edge pieces when seen in cross-section must be planar at least in a partial region of its extent, this is not a necessary condition for the course in the circumferential direction. Instead, the edge course of the circumferential edge pieces in the circumferential direction may be convexly or concavely curved, with wave-like and angled edge courses also being possible. Of course, the edge course of the circumferential edge pieces in the circumferential direction may also be plane. This latter embodiment is less costly to produce and therefore advantageous.

It is also possible for a plurality of circumferential edge pieces to be arranged one beside the other in the circumferential direction, either immediately adjoining one another or separated from one another by intervening spaces. If a plurality of circumferential edge pieces arranged one beside the other are present, the individual circumferential edge pieces may be situated at different levels, i.e. they may protrude at different distances and/or, when seen in cross-section, be at greater or lesser distances away from the upper face. Such configurations of the circumferential edge pieces make it possible to realise additional, stability-promoting interlocking effects in particularly critical regions of a jigsaw puzzle which require particularly high stability.

In preferred embodiments of the jigsaw puzzle according to the invention, the contact in the region of each undercut, which contact together with the contact places at the circumferential edge pieces ensures that joined-together puzzle pieces are drawn closer to one another, is approximately punctiform or at any rate of small extent in the circumferential direction of the edge of a recess or an extension. Such approximately punctiform contact places in the region of an undercut do not interfere with the insertability of an extension into a recess or vice versa and are perfectly sufficient as supporting places for forming the described triangle of forces. In principle, even a single, preferably approximately punctiform, contact place in the region of an undercut is sufficient to form the said triangle of forces together with the further contact places at the circumferential edge pieces. Advantageously, however, two such contact places are used in the region of an extension or a recess, one on each side of the extension or the recess, respectively, in each case in the region of an undercut. In this way, the forces are applied symmetrically and thus more uniformly. Optionally, more than two preferably punctiform contact places may also be used in the undercut region.

In preferred configurations, each punctiform contact is realised by a projection extending from the circumferential edge of the recess or of the extension, which projection is, for example in the case of puzzle pieces produced by means of injection moulding, formed integrally with the respective puzzle piece. The projection or projections preferably do not extend to the upper face and/or to the lower face of the recess or of the extension, so that they are not visible to the naked eye from the upper face and/or the lower face in the assembled state of the puzzle pieces. In any case, these projections may be designed to be so small that they are not visible to a normal user of the jigsaw puzzle.

According to a development, each projection is assigned a corresponding indentation in the opposite edge of the extension or of the recess, respectively. Without the corresponding indentation, each projection causes a preferably punctiform clamping between an extension and the associated recess, whereas with a corresponding indentation this clamping effect likewise occurs, but is additionally complemented by a perceptible latching on assembly of the puzzle pieces and results in a particularly precise fitting of the puzzle pieces into one another. In this way, the haptic quality of the puzzle assembly process is enhanced, since there is conveyed to a player the feeling of puzzle pieces fitting into one another exactly and with a defined effort.

Finally, preferred embodiments of the jigsaw puzzle according to the invention have in the contact-free region of the circumferential edge a predetermined minimum distance between mutually facing circumferential edge portions, in order to ensure that a contact actually occurs only at the circumferential edge pieces.

The individual puzzle pieces of a jigsaw puzzle according to the invention are preferably composed of plastic, although the present invention is not restricted to puzzle pieces made of plastic. For example, the puzzle pieces may also be composed of metal, for instance aluminium, or of wood. It is likewise conceivable for the puzzle pieces to be produced from a sufficiently stable cardboard material. The puzzle pieces may also be of multilayer construction and the individual layers may be composed of different materials. For example, each puzzle piece may have a core made of cardboard material, which is coated with plastic on the upper face and/or lower face, for instance by means of a plastic film. Other material combinations are likewise conceivable.

If the individual puzzle pieces of a jigsaw puzzle according to the invention are composed of plastic, then these pieces are preferably produced by plastic injection moulding. Very dimensionally accurate, stable puzzle pieces are thus obtained at reasonable production costs. If the puzzle pieces are composed of a metal, the metal should preferably be castable, in order to be able to produce the individual puzzle pieces also by a die-casting process, for instance by means of an aluminium die-casting process. Alternatively, however, stamping processes may also be used to produce the puzzle pieces, depending on the material selected for them.

Figure 1B:
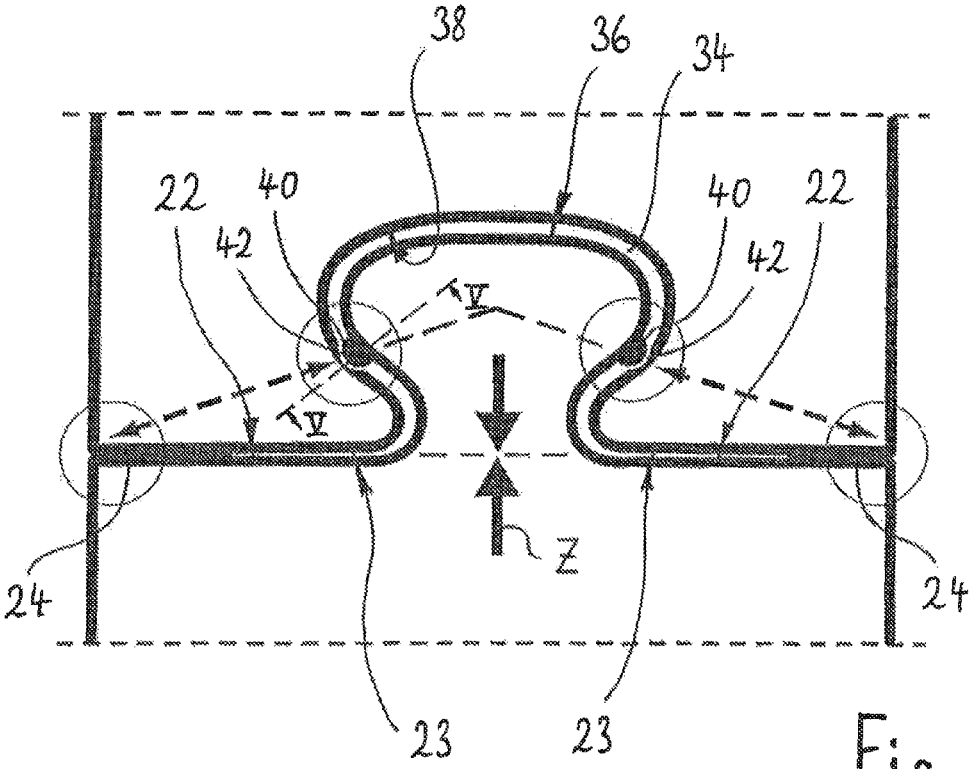
Figure 2:
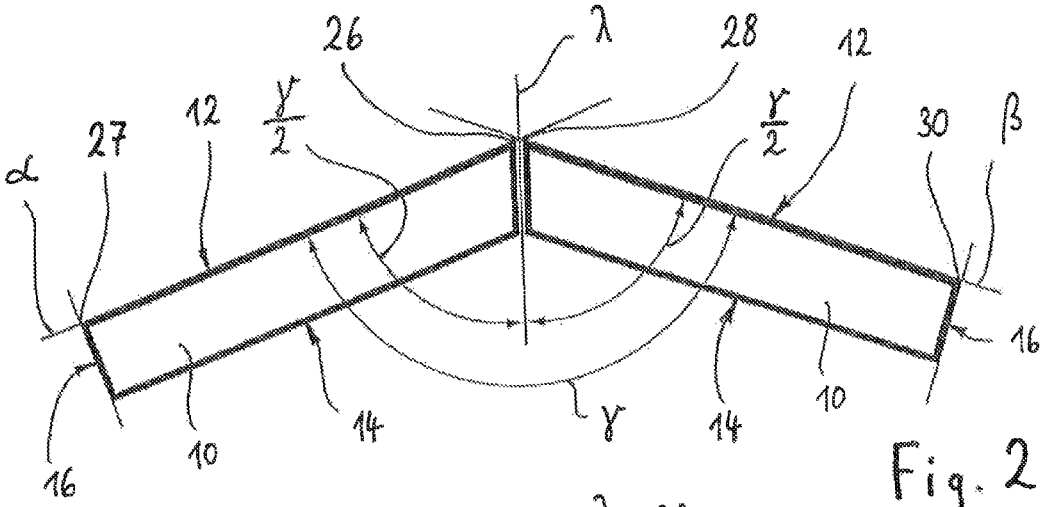
Figure 3:
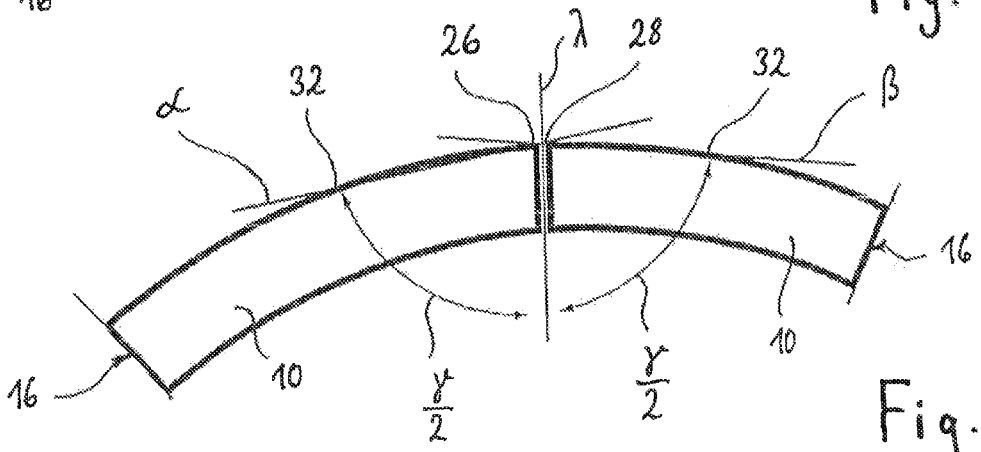
Figure 4:
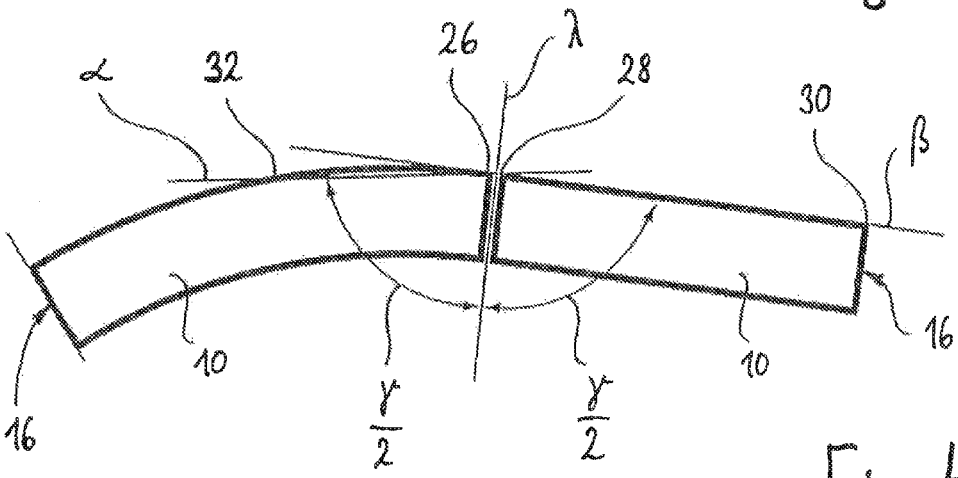
Figure 5:
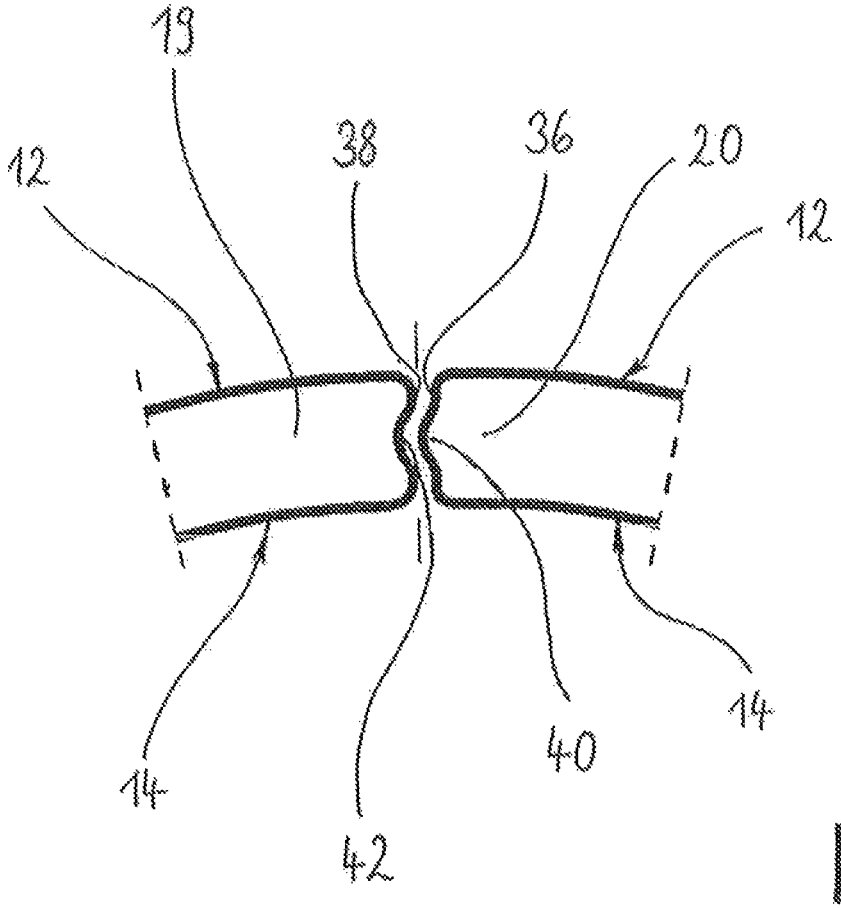
Figure 6A:
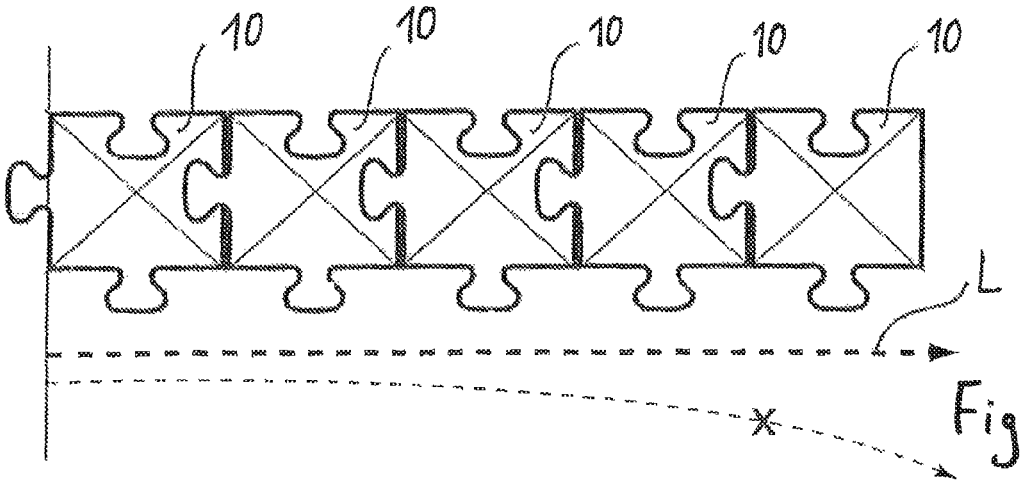
Figure 6B:
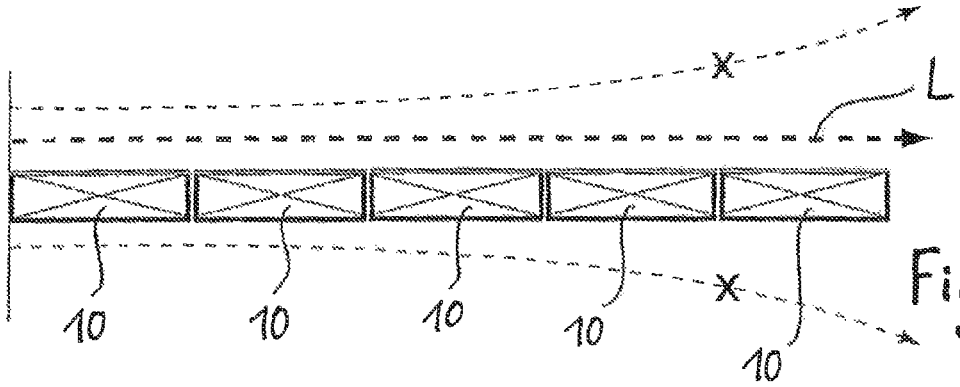
Figure 7:
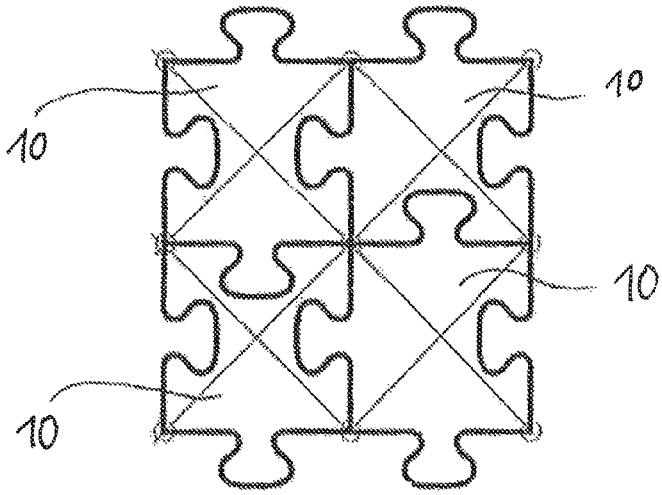

Exemplary embodiments of the jigsaw puzzle according to the invention are explained below in more detail with reference to the attached, schematic figures, in which:

FIG. 1A shows a plan view of a puzzle piece having two connecting regions, one being formed as an extension and the other as a recess, FIG. 1B shows in plan view an enlarged illustration of the connecting regions of two joined-together puzzle pieces, FIG. 2 shows a cross-section through two adjoining, plane puzzle pieces, FIG. 3 shows a cross-section through two adjoining, curved puzzle pieces of different dimension, FIG. 4 shows a cross-section through two adjoining puzzle pieces, one of which is plane and the other curved, FIG. 5 shows the section V-V from FIG. 1B, FIG. 6A shows five puzzle pieces interconnected along a longitudinal direction L in plan view, FIG. 6B shows the five puzzle pieces from FIG. 6A in section, and FIG. 7 shows four puzzle pieces interconnected to form an approximately square area to illustrate a stabilising network of force lines formed according to the invention.

FIG. 1A shows, by way of example, a puzzle piece 10 having an upper face 12 and a lower face 14, visible only in the sectional illustration of FIGS. 2 to 4 for example. Extending between the upper face 12 and the lower face 14 is a circumferentially extending circumferential edge 16 which is defined by the material thickness of the puzzle piece 10 and from which extend here two connecting regions 18, marked by broken lines.

One connecting region 18 has the form of a recess 19 extending into the puzzle piece 10, while the other connecting region 18 has the form of an extension 20 extending away from the puzzle piece 10.

The circumferential edge 16 running around the puzzle piece 10 is not part of the connecting regions 18, only the edge portions which belong to a recess 19 or an extension 20 form a part of the respective connecting region 18.

Both the recess 19 and the extension 20 are designed with in each case two undercuts 21 in the example shown. To each recess 19 and each extension 20 there corresponds in an adjoining puzzle piece a correspondingly formed extension and a correspondingly formed recess, respectively, so that two adjoining puzzle pieces 10 can be connected to one another by fitting the connecting regions 18 into one another. It is understood that a plurality of recesses 19 and/or extensions 20 may be present on a puzzle piece 10 and that their shape may differ in each case.

A multiplicity of puzzle pieces 10, the appearance of which may of course differ from one another, results, in the assembled state, for example in a two-dimensional area or else a hollow body, such as, for instance, a cube, a sphere, a pyramid, an octahedron, a cuboid, a heart, a bear or another animal or else a building. To ensure that such a formation is sufficiently stable in the assembled state and that the individual puzzle pieces 10 can be assembled simply and yet exactly, mutually facing circumferential edge portions 22 of a first puzzle piece 10 and 23 (see FIG. 1B) of a second puzzle piece 10 are formed on both sides of the connecting region 18 such is that they touch merely at circumferential edge pieces which are associated with the circumferential edge portions 22, 23 and arranged, in the exemplary embodiment shown, in each case in the immediate vicinity of a corner 25 (see FIG. 1A) of the puzzle piece. Along these circumferential edge pieces 24, for each two adjoining puzzle pieces, the course of the mutually facing circumferential edges 16 between the upper face 12 and the lower face 14, i.e. when seen in the cross-sectional direction of the puzzle piece, is determined by a bisector λ of a dihedral angle γ formed between two straight lines α and β (see FIGS. 2 to 4).

In FIG. 2, which shows a section through two adjoining puzzle pieces 10 of approximately equal size, the straight line a extends from an upper end point 26 of the circumferential edge 16, associated with the puzzle piece 10 on the left in FIG. 2, of the two mutually facing circumferential edges 16 to an upper end point 27 of an opposite circumferential edge 16 of the same puzzle piece 10 on the left in FIG. 2. Analogously, the straight line β extends from an upper end point 28 on the puzzle piece 10 on the right in FIG. 2 to an upper end point 30 of the same puzzle piece. The two straight lines α and β defined by the upper end points 26 and 27, and 28 and 30, form the dihedral angle γ between them and intersect on the bisector λ of this dihedral angle γ. The edge course of the mutually facing, touching circumferential edge pieces 24 of the two puzzle pieces 10, between the upper face 12 and the lower face 14 of the associated puzzle piece 10, follows the bisector λ.

In FIG. 3, a section through two adjoining, curved puzzle pieces 10 of different size is shown. Here too, the edge course of the mutually contacting circumferential edge pieces 24 between the upper face 12 and the lower face 14 of the associated puzzle piece 10 is determined by two straight lines α and β which, just as previously described, start from the upper end point 26 and 28, respectively, and extend, differently from FIG. 2, to a maximum 32 on the convexly curved upper face 12 in the direction of an opposite circumferential edge 16 of the same puzzle piece. The bisector λ of the dihedral angle γ formed between the two straight lines α and β once again determines the edge course in the circumferential edge pieces 24 of the mutually facing circumferential edges 16 between the upper faces 12 and the lower faces 14 of the puzzle pieces 10. Since curved puzzle pieces 10 do not necessarily have to have a constant radius of curvature over their entire extent and may even be curved oppositely over their extent, it is advantageous to define the straight lines α and β by the maximum 32, nearest to the mutually facing circumferential edges 16, is on the upper face 12 of curved puzzle pieces 10.

FIG. 4 shows a section through two adjoining puzzle pieces, the left puzzle piece 10 of which is curved and the right puzzle piece 10 of which is plane. In the case of the curved puzzle piece 10, the straight line α is determined according to FIG. 3, and in the case of the plane puzzle piece 10, in contrast, the straight line β is determined according to FIG. 2.

By means of the design specification stated above, the edge course in the cross-sectional direction along the circumferential edge pieces 24 of the circumferential edge portions 22, 23 of puzzle pieces 10 of virtually any desired shape can be defined such that a fit between the puzzle pieces which is exact and provides good mutual support of the puzzle pieces is always guaranteed. It should be pointed out here that the circumferential edge 16 is only the edge of the main body of the puzzle piece, and that the design specifications given above therefore do not apply to the part of the circumferential edge situated in the connecting regions 18.

With reference to FIG. 1B, which shows in plan view an enlarged illustration of two connecting regions 18, inserted into one another, of two adjoining puzzle pieces 10, the design specification for the edges of the connecting regions 18 will now be is explained. As can be clearly seen in FIG. 1B, a small gap 34 exists between the extension 20 and the corresponding recess 19, which gap results from the fact that in the connecting region 18 the circumference of an edge 36 of each extension 20 is slightly smaller than the circumference of an edge 38 of the recess 19 corresponding to the extension 20 in the adjoining puzzle piece 10. In FIG. 1B, the size of the gap 34 is illustrated with an exaggerated size for reasons of clarity. In reality, the gap dimension will be chosen such that the gaps 34 are not disturbingly evident in the assembled puzzle and ideally are not visible to the naked eye.

For improvement of the connecting quality between individual puzzle pieces 10 and to produce a high-quality feel of the puzzle, in the exemplary embodiment shown, there are provided—as can likewise be seen from FIG. 1B—two projections 40 between two respectively corresponding connecting regions 18, which projections extend here from the edge 36 of the extension 20 and are in approximately punctiform contact with the opposite edge 38 of the recess 19. Each projection 40 is approximately hemispherical here and engages in a spherical-cap-shaped indentation 42 formed in the edge 38 (see also the sectional illustration in FIG. 5). The two projections 40 are arranged opposite one another on the extension 20 at a place at which the undercuts 21 of the extension 20 begin. In this way, on insertion of the extension 20 into the recess 19, the puzzle piece 10 provided with the extension 20 is drawn, as symbolised by an arrow Z, in the direction of the puzzle piece 10 provided with the recess 19 and the mutually facing circumferential edge portions 22 and 23 of the two puzzle pieces 10 are laid against one another by their circumferential edge pieces 24 in a supporting manner and so as to be secure against tilting. A triangle of forces, shown by broken lines in FIG. 1B, which stabilises the puzzle piece assembly arises between the contact places formed by the circumferential edge pieces 24 and the contact places formed by the projections 40.

As can be seen from FIG. 5 which has already been mentioned, when seen in the cross-sectional direction, each projection 40 is formed only in a central region of the edge 36, as is each indentation 42 in the edge 38. The approximately punctiform latching connection formed from projection 40 and associated indentation 42 is therefore practically not visible from the upper face 12 or the lower face 14 of the puzzle pieces 10. This also applies if, as shown in FIG. 5, the edges of the recess 19 and of the extension 20 are not of sharp-edged, but rounded design.

FIG. 6A shows in plan view, and FIG. 6B in section, five plane puzzle pieces 10 which are interconnected along a direction L and of which the connecting regions 18 and mutually facing circumferential edge portions 22 and 23 are formed as explained above with reference to FIGS. 1A and 1B. It can be seen in particular from FIG. 6B that the assembly formed of the five puzzle pieces 10 does not bend increasingly in a direction x or even break up, as with conventionally designed puzzle pieces, but extends in the manner of a cantilever in a straight line in a self-supporting manner without discernible bending. This is achieved by the network of force lines indicated in FIG. 6A, which results owing to the mutual clamping of the individual puzzle pieces 10 at the predetermined contact places and excellently stabilises the puzzle piece assembly.

FIG. 7 shows in plan view four puzzle pieces 10 formed as described above, assembled to form a plane, substantially square area. Here too, there results the illustrated network of force lines between the individual puzzle pieces 10 which, in the assembled state of all the puzzle pieces, extends over the puzzle piece assembly and ensures excellent stability together with very good puzzle assemblability.

The invention claimed is:

1. A jigsaw puzzle, comprising:

at least two puzzle pieces, each of which has an upper face, a lower face and a circumferential edge extending between the upper face and the lower face, each puzzle piece having a circumferential edge portion which faces a circumferential edge portion of the other puzzle piece, and at least one connecting region extending from the circumferential edge portion in the form of a recess or an extension, which is provided with at least one undercut and is formed so as to be complementary to the extension or the recess in a connecting region of the facing circumferential edge portion of the respective other puzzle piece, wherein each of the mutually facing circumferential edge portions on both sides of the connecting region and remote from the latter has at least one circumferential edge piece, along which the course of the circumferential edge, when seen in cross-section, over at least part of its extent between the upper face and the lower face is determined by the bisector of a dihedral angle formed between two lines which intersect on the bisector and which extend from an upper end point of the associated one of the mutually facing circumferential edge portions of the two puzzle pieces to an upper end point of an opposite circumferential edge of the same puzzle piece, and wherein when the puzzle pieces are joined together along mutually facing circumferential edge portions, contact between the two puzzle pieces occurs exclusively at the circumferential edge pieces and in the region of the undercut.

2. The jigsaw puzzle according to claim 1, wherein the circumferential edge pieces are arranged in a manner adjoining corners of the puzzle piece or neighbouring these corners.

3. The jigsaw puzzle according to claim 1, wherein along the circumferential edge pieces the circumferential edge, when seen in cross-section, substantially over its entire extent is determined by the bisector of the dihedral angle.

4. The jigsaw puzzle according to one of claim 1, wherein along the circumferential edge pieces the circumferential edge is plane.

5. The jigsaw puzzle according to claim 1, wherein a plurality of circumferential edge pieces are arranged one beside the other in a circumferential direction.

6. The jigsaw puzzle according to claim 5, wherein the plurality of circumferential edge pieces are situated at different levels.

7. The jigsaw puzzle according to claim 1, wherein each contact in the region of an undercut is approximately punctiform.

8. The jigsaw puzzle according to claim 7, wherein each punctiform contact is realised by a projection extending from the circumferential edge of the recess or of the extension.

9. The jigsaw puzzle according claim 8, wherein each projection does not extend to the upper face and/or to the lower face of the recess or of the extension.

10. The jigsaw puzzle according to claim 9, wherein each projection is assigned a corresponding indentation in the opposite edge of the recess or of the extension, respectively.

11. The jigsaw puzzle according to claim 1, wherein in a contact-free region of the circumferential edge there is a predetermined minimum distance between mutually facing circumferential edge portions.

12. The jigsaw puzzle according to claim 1, wherein a plurality of joined-together puzzle pieces are held together by forces which extend along a network of force lines which stretches between the contact places at the circumferential edge pieces and in the region of each undercut.

13. The jigsaw puzzle according to claim 12, wherein the plurality of joined-together puzzle pieces are joined together along one direction.

14. The jigsaw puzzle according to claim 12, wherein the plurality of joined-together puzzle pieces form an area.

15. The jigsaw puzzle according to claim 1, wherein the two lines are straight.

16. The jigsaw puzzle according to claim 1, wherein a puzzle piece includes a convexly curved upper face, to a first maximum in the direction of an opposite circumferential edge of the same puzzle piece.

* * * * *